US011608586B2

(12) United States Patent
Baggio

(10) Patent No.: US 11,608,586 B2
(45) Date of Patent: Mar. 21, 2023

(54) COVER ELEMENT FOR AN IRONING SURFACE

(71) Applicant: SIRETESSILE S.R.L, Cornuda (IT)

(72) Inventor: Gianfranco Baggio, Cornuda (IT)

(73) Assignee: SIRETESSILE S.R.L., Cornuda (IT)

( * ) Notice: Subject to any disclaimer, the term of this patent is extended or adjusted under 35 U.S.C. 154(b) by 34 days.

(21) Appl. No.: 17/349,049

(22) Filed: Jun. 16, 2021

(65) Prior Publication Data

US 2021/0395943 A1 Dec. 23, 2021

(30) Foreign Application Priority Data

Jun. 18, 2020 (IT) ..... 102020000014602

(51) Int. Cl.
*D06F 83/00* (2006.01)

(52) U.S. Cl.
CPC ..... *D06F 83/00* (2013.01)

(58) Field of Classification Search
CPC ..... D06F 83/00; D06F 85/00; D06F 81/00
See application file for complete search history.

(56) References Cited

U.S. PATENT DOCUMENTS

| | | | | |
|---|---|---|---|---|
| 2,267,112 | A | 12/1941 | Kovalik | |
| 2,298,927 | A | 10/1942 | Callan | |
| 2,570,110 | A | 10/1951 | Glatt | |
| 2,600,913 | A | 6/1952 | Olson | |
| 3,636,644 | A | 1/1972 | Janetzke | |
| 3,668,142 | A | 6/1972 | Goodlow | |
| 3,733,724 | A | 5/1973 | Davis | |
| 4,186,489 | A * | 2/1980 | Vigilante | D06F 81/00 33/2 H |
| 4,360,984 | A | 11/1982 | Ruttenberg | |
| 4,849,044 | A | 7/1989 | Siniscalchi | |
| 4,920,669 | A | 5/1990 | Mattesky | |
| 5,259,131 | A | 11/1993 | Mattesky | |
| 5,566,481 | A | 10/1996 | Lehrman | |
| 7,299,573 | B1 | 11/2007 | Kuncken | |
| 2009/0173648 | A1* | 7/2009 | Geneva | A45C 11/008 206/349 |
| 2013/0111787 | A1 | 5/2013 | Areyur et al. | |
| 2014/0190048 | A1* | 7/2014 | Ji | B32B 3/10 38/140 |
| 2014/0259328 | A1 | 9/2014 | Maples et al. | |

FOREIGN PATENT DOCUMENTS

| | | | | |
|---|---|---|---|---|
| CN | 207295234 U | * | 5/2018 | A47D 11/00 |
| DE | 29704672 U1 | | 8/1997 | |
| DE | 202004012097 U1 | * | 11/2004 | B32B 27/12 |
| DE | 102010000379 B4 | | 5/2013 | |

(Continued)

*Primary Examiner* — Ismael Izaguirre
(74) *Attorney, Agent, or Firm* — Carmel Patent Agency; Robert Ballarini

(57) ABSTRACT

Cover element for an ironing surface includes: a first layer of fabric which extends substantially for the entire surface development of said element, the first layer being constituted by a fabric with fibers that resist, without undergoing any damage or alteration, temperatures above about 180° C., for at least 5 minutes; and at least one underlying support layer, which is positioned below the first layer and which includes an impermeable polymeric membrane.

17 Claims, 5 Drawing Sheets

(56) References Cited

FOREIGN PATENT DOCUMENTS

| | | | | | |
|---|---|---|---|---|---|
| DE | 202014004202 | U1 | | 3/2014 | |
| EP | 126530 | A | * | 11/1984 | ..... A47G 25/72 |
| EP | 2166148 | A1 | | 3/2010 | |
| GB | 2536667 | A | * | 9/2016 | ..... A47D 11/00 |
| IT | 1277721 | A1 | | 11/1997 | |
| NL | 1035968 | B3 | | 3/2010 | |
| WO | WO-2019002592 | A1 | * | 1/2019 | ..... D06F 83/00 |

* cited by examiner

COVER ELEMENT FOR AN IRONING SURFACE

FIELD OF THE INVENTION

The present invention relates to an improved covering element for ironing surfaces, in particular of the type with cover for ironing boards.

Hereinafter, the term "cover element" or "cover" specifically refers to the element that covers and/or wraps the ironing surface, and in particular the upper surface of the ironing board, and on which the garment to be ironed and/or the iron is directly placed, thus excluding the additional accessories that are used to be positioned between this cover element/cover and the surface/ironing board and which, therefore, are not in direct contact with the garment to be ironed. In particular, the cover is used to cover an ironing board, and more precisely it is placed between the board itself and the fabric to be ironed, in order to protect the ironing board from the heat and steam coming from the iron, and also to make it easier to slide the iron on the surface, making the operation easier and safer.

BACKGROUND

Currently, for the production of ironing board covers, the use of a multilayer consisting of an external layer of fabric, one or more intermediate layers of flannel or rubber, for example of expanded polyurethane, and an internal metallized layer is already known. Such a multilayer is described for example in NL1035968 where it is also provided that the metallized inner layer is supported at the bottom by a foam substrate.

Furthermore, IT1277721 (application no. MI1995A002751) describes a covering material for ironing surfaces formed by an upper outer layer of fabric, a first underlying intermediate layer in polymeric material, a second underlying intermediate layer consisting of a metallized film and a lower basic interior layer in a material selected from natural fiber, synthetic fiber, polyurethane foam, polyethylene foam or PVC foam.

However, these solutions are not fully satisfactory since, due to the high heat generated by the iron plate, the covering element—and in particular its outermost layer—can be irreparably damaged if the plate of the iron is left in contact with the cover element for too long.

Therefore, if the iron is to be left inactive, it is currently necessary to rest it in a substantially vertical position, in order to prevent the heated plate from coming into contact with the covering element of the ironing board. However, when the iron is in this position, the heated plate is exposed, with consequent heating of the surrounding environment, and with risks for the safety of the user who could come into contact with the plate itself, thus causing a burn. Furthermore, the vertical support position of the iron is generally not stable and, therefore, there is a risk that the iron itself may fall off the ironing board, thus causing its breakage or causing damage to surrounding objects and/or the floor.

US2013/0111787 discloses a covering element for ironing surfaces made with a fabric composed of 95-97% cotton and 3-5% spandex or lycra. However, this solution is not fully satisfactory as the fabric withstands temperatures of 230° C. only for a few seconds, while resistance for long periods of time (up to 2 hours) is only guaranteed for temperatures up to 180° C. Furthermore, the permanence of a steam iron on a cotton surface for such a long time inevitably leads to the penetration of humidity inside the element itself, thus inevitably wetting the underlying ironing board. Furthermore, under the layer of cotton and spandex/lycra fabric, a felt layer can be coupled which—as known—is not breathable.

DE202014004202 describes an ironing press comprising a pair of ironing elements configured to be brought up against each other so as to iron an item of clothing that has been positioned between the two. The upper element, which includes a steam tank, can be heated to about 160° C. and, in order to protect the garment to be ironed from excessive heat, is covered with a cover consisting of various layers of mesh and aramid fiber felt, all vapor permeable. However, even this solution is not fully satisfactory since the positioning of the cover to cover the hot surface substantially reduces the amount of heat that reaches the garment to be ironed, thus considerably lengthening the time required to perform the ironing operations.

U.S. Pat. No. 3,667,412 describes a covering element for ironing boards made from a mesh of threads of elastic material, preferably of natural or synthetic rubber. Threads of non-elastic material can also be added to these threads of the knitting, for example Nomex® with a ratio between 1:10 and 10:1. However, this solution is not fully satisfactory since in the range of ratios identified the resistance to high temperatures of the covering element thus made varies widely, and therefore it is not possible to leave the iron on the surface of the covering element for a substantially long without causing irreversible damage.

U.S. Pat. No. 3,733,724 describes a covering element for ironing boards comprising an underlying non-woven and punched layer in resilient material made with an aromatic nylon yarn resistant to high temperatures, for example Nomex®, of which a portion—which is intended for ironing—is then covered with a layer made of Nomex®, while the portion for the support of the iron is made of a nylon fabric resistant to high temperatures. This solution is not fully satisfactory as the use of Nomex® for the underlying resilient layer does not guarantee that the layer itself is waterproof, especially following punching.

SUMMARY

The object of the invention is to propose a covering element for an ironing surface, which resolves, in whole or at least in part, the aforementioned drawbacks present in traditional solutions.

Another object of the invention is to propose an element for covering ironing surfaces, which allows simplifying and facilitating the ironing operations.

Another object of the invention is to propose an element for covering ironing surfaces, which reduces the heat and steam reflected towards the operator during ironing.

Another object of the invention is to propose an element for covering ironing surfaces, which allows significant energy savings.

Another object of the invention is to propose an element for covering ironing surfaces, which is easy to fold and has a particularly limited bulk when folded, and is thus highly portable.

Another object of the invention is to propose an element for covering ironing surfaces, which avoids or at least limits the possibility of burning or damaging the element itself or the underlying support/support base.

Another object of the invention is to propose an element for covering ironing surfaces, which does not deform permanently as a result of exposure to the high temperatures of the ironing.

Another object of the invention is to propose an element for covering ironing surfaces, which adequately protects the ironing surface from the heat and/or steam produced by the iron.

Another object of the invention is to propose an element for covering ironing surfaces, which avoids or reduces the risk of ignition of a fire and/or reduces the risk of electric shock for the user.

Another object of the invention is to propose an element for covering ironing surfaces which can be applied quickly and easily to the support base and which, during the ironing operations, remains immobile and stably bound to said base.

Another object of the invention is to propose an element for covering ironing surfaces which is an alternative to and improved with respect to traditional solutions and in particular to products currently on the market.

Another object of the invention is to propose an element for covering ironing surfaces, which can be obtained simply, quickly and with low costs.

All these purposes, either alone or in any combination thereof, and others, which will result from the following description, are achieved, according to the invention, with an ironing surface covering element as defined in claim 1.

BRIEF DESCRIPTION OF THE DRAWINGS

The present invention is herebyhereinafter further clarified in a preferred embodiment thereof reported for purely illustrative and non-limiting purposes with reference to the attached drawing tables, in which.

DETAILED DESCRIPTION OF THE PREFERRED EMBODIMENTS

Figure 1:
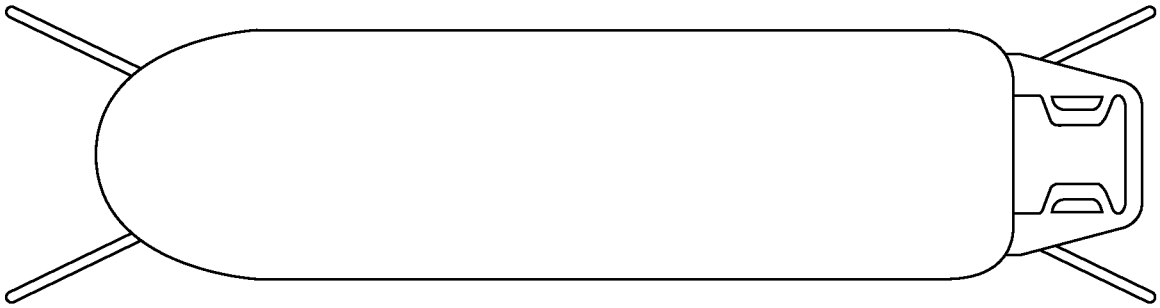
FIG. 1 shows in plan the element for covering ironing surfaces according to the invention mounted on an ironing board.
Figure 2:
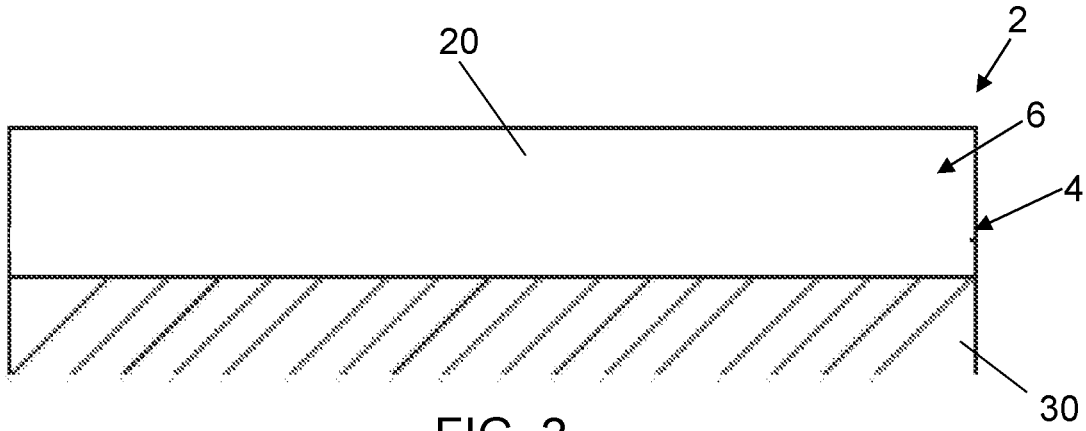
FIG. 2 shows a schematic vertical section of the cover element in a first embodiment.
Figure 3:
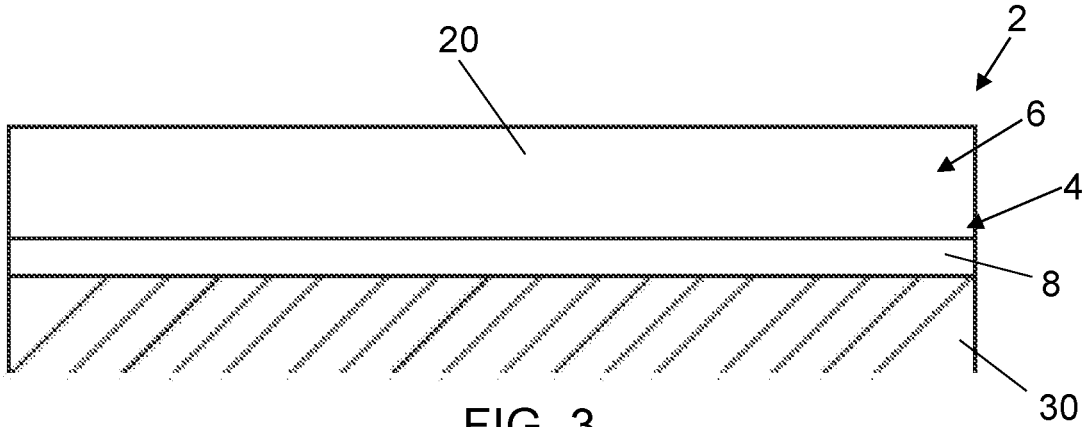
FIG. 3 shows it in a second embodiment.

Conveniently, it is understood that in the figures the different layers are not illustrated in their real proportions, but are illustrated with fictitious proportions and intended for the understanding of the present invention.

Conveniently, in the following by ironing surface 30 is meant the surface, preferably flat, to be covered by using the covering element 2 according to the invention. In particular, the ironing surface 30 can be defined by an ironing base and/or the ironing board and/or in general the shelf, which is covered with the element 2.

Advantageously, the element 2 has a substantially conformation laminar, that is, its thickness is much less than the other two dimensions.

Advantageously, the covering element 2 defines a cover to be applied on an ironing board defining said ironing surface 30. Alternatively, the ironing surface 30 can be defined by the upper surface of a piece of furniture and/or a household appliance. In particular, the ironing surface 30 may not be heated directly.

Conveniently, the upper surface of the covering element 2 can be configured to come into direct contact with the surface of an iron and/or with a garment to be ironed.

Advantageously, the covering element 2 is configured to wrap, in whole or in part, the upper base of the ironing surface 30, such as in particular the upper surface of the ironing board. Conveniently, the covering element 2 is used so as to be in direct contact with the upper base of the ironing board, and therefore with the ironing surface 30, without the interposition of further accessories or materials.

Conveniently, hereinafter by "upper" and/or "external" it is meant that a corresponding layer, when the covering element 2 is in use (ie when it is applied so as to cover the underlying ironing surface 30), is further away from the ironing surface itself and closer to the items to be ironed and/or the iron.

Conveniently, below by "lower" and/or "internal" it is meant that a corresponding layer, when the covering element 2 is in use, is located more in proximity to the underlying ironing surface 30 can be seen As from the figures, the The element 2, according to the invention, for covering an ironing surface 30 is constituted or comprises at least a first layer 6 in fabric 20 resistant to high temperatures, in particular it is in fabric 20 which comprises—at least in part, or for most or wholly/only—fibers which resist, without undergoing any damage or alteration, to temperatures higher than about 180° C., preferably about 200-400° C., and more preferably about 200-240° C., for at least 5 minutes, preferably for 10-15 minutes up to several days.

Preferably, said first layer 6 is configured to be the upper and/or outermost layer of the ironing element 2. In particular, the upper and/or external surface of said first layer 6 can be configured to come into contact with said iron. for ironing 21 and/or with said garment to be ironed.

Advantageously, said first layer 6 is a fabric 20 made, at least in part or entirely, with fibers of a material capable of reflecting, or absorbing and subsequently dispersing, the heat generated by the heated plate of the iron 21, and this without undergoing drastic changes in its conformation (melting, permanent deformation, appearance of cracks or other) and also avoiding modifications of any other underlying and more internal layers with respect to said first layer 6.

Considering that the traditional temperatures of use of the iron 21 are higher than 100° C. and that, in particular, the heated plate of the iron reaches temperatures of about 130° C.-230° C., then the same plate heated to these temperatures can be left resting on the upper and/or external surface of the first layer 6 for an indefinitely long time without causing drastic modifications and/or damage to the first layer and/or any the underlying layers.

Advantageously, the fabric 20 of said first layer 6 can have good sliding properties, thus making it possible to facilitate the ironing operations.

Preferably, in a possible embodiment, the fabric 20 of said first layer 6 can be made, at least partially, of fibers of polymeric material resistant to high temperatures. Preferably, in a possible embodiment, the fabric 20 of said first layer 6 can be made for the most part of fibers of polymeric material resistant to high temperatures. Preferably, in a possible embodiment, the fabric 20 of said first layer 6 can be made entirely and only of fibers of polymeric material resistant to high temperatures.

Advantageously, said high temperature resistant polymeric material can comprise aromatic polyamides (aramides). Conveniently, the fabric 20 of said first layer can be made entirely or partially with fibers of aromatic polyamides linked in a meta position (meta-aramidic), such as for example Nomex® or in a para position (para-aramidic), such as Kevlar®. Advantageously, the fabric 20 can be formed by a set/mix of meta-aramid and para-aramid fibers. Advantageously, the fabric 20 can be composed of a set of fibers, of which about 90-99% are meta-aramid fibers and about 1-10% are para-aramid fibers, preferably about 95% are meta-aramid fibers and about 5% are para-aramid fibers.

Advantageously, said first layer 6 is made partly or entirely of aramidic fiber fabric. Preferably, said first layer 6 can be made in a percentage comprised between 30 and 70%, and preferably about 50%, of aramidic fibers.

Advantageously, the polymeric material of the first layer 6 resistant to high temperatures can further comprise polymers derived from wood, such as for example viscose.

Preferably, said first layer 6 can be made in a percentage comprised between 30 and 70%, and preferably about 50%, of aramid fibers, and a percentage comprised between 70 and 30%, and preferably about 50%, viscose. Advantageously, said aramid fibers and said viscose fibers can be in an intimate blend. Preferably said first layer 6 can be constituted by an intimate blend of aramidic fibers and viscose fibers.

Preferably, the fabric 20 of said first layer 6 can be made, at least partially, of fibers/threads of metal material resistant to high temperatures.

Conveniently, the fabric 20 with which said first layer 6 is made can be of various types and, in particular, can have various weights and, in more detail, can be light (i.e. with a weight of less than 50 gr/m2) or heavy (i.e. with a weight greater than 200 gsm). Preferably, the fabric 20 has a grammage of about 50-90 g/m2 in the case in which the fabric 20 comprises only aramid fibers, or it can be greater than 150 g/m2 in the case in which the fabric 20 comprises a set (mix) of aramid and viscose fibers.

Advantageously, the first fabric layer 6 can be non-slip, to prevent the items to be ironed from moving relative to the ironing board. Advantageously, the first fabric layer 6 can be Sanforized.

Advantageously, the first fabric 20 layer 6 can be substantially elastic, in order to adapt correctly to the shape of the ironing board.

Advantageously, the first fabric layer 6 can be made of fabric 20, which is breathable, in order to allow the passage of the humidity generated by the iron 21.

Advantageously, the first layer 6 can be fireproof.

Advantageously, the first layer 6 extends and substantially affects the entire surface development of the ironing element 2.

Figure 6:
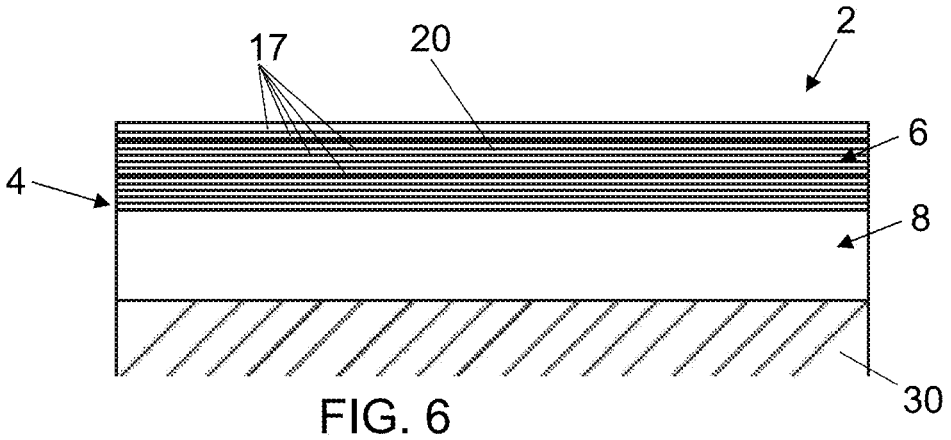
FIG. 6 shows it in a fifth embodiment.

Advantageously, the first layer 6 can be electrically conductive (see FIG. 6,7). Conveniently, this allows to avoid problems of discharges due to the fact that the power cable of the iron 21 has a partially damaged sheath, for example following contact with the hot plate, or in any case problems related to static electricity that can accumulate by rubbing, in the case of ironing clothes, for example made of synthetic materials, which are repeatedly rubbed against the element 2, particularly in the case of dry ironing.

Advantageously, in a first possible embodiement (see FIG. 6) of the first layer 6, the latter comprises a fabric layer 20 in which wires 17 of electro-conductive material are inserted or used, such as for example carbon nanotubes or silicon, whiskers of conductive materials, or, preferably, metal wires. Preferably, the wires 17 are made of aluminum, copper or silver, so as to ensure optimal thermal conductivity.

Advantageously, moreover, the electro-conductive wires 17 confer greater rigidity and resistance to the first layer 6.

Conveniently, the wires 17 are applied to the fabric defining a crisscross weft and this in order to allow the wires 17 to touch each other along the entire length surface extension of the fabric and thus obtain conductivity over the entire surface extension of the first layer 6.

Figure 7:
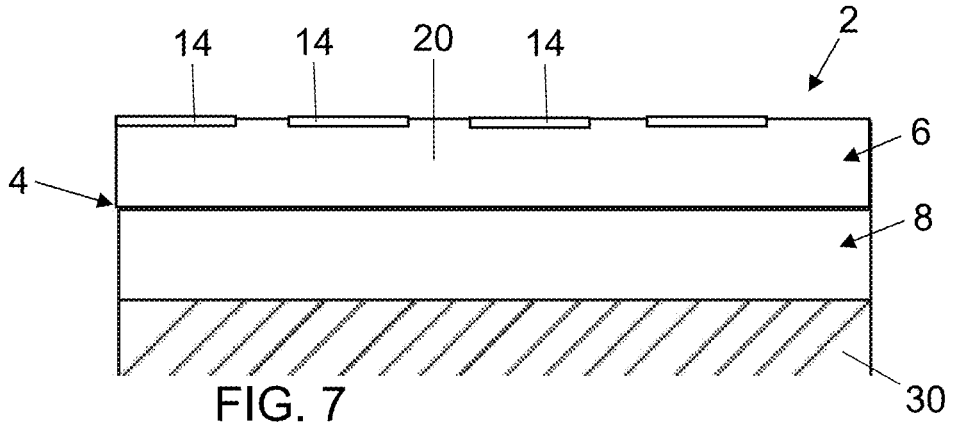
FIG. 7 shows it in a sixth embodiment.

Advantageously, in a second possible variant (see FIG. 7) of the first layer 6, the latter comprises printed electroconductive portions 14. In particular, a print in electro-conductive material, preferably with the addition of graphite or a conductive metal, can be applied to this first layer 6. In particular, the printing in electro-conductive material is obtained by depositing on the upper surface of the fabric an electro-conductive material thus defining a plurality of surface traces/tracks, preferably interconnected with each other. Conveniently, this print obtained on said first layer 6 can be carried out by means of a textile printing technique and, in particular, it can be carried out by rotary printing with cylinder, transfer printing, digital printing, panel printing, hand printing or machine printing. Preferably, in this embodiment, the fabric 20 of the first layer 6 can have a grammage higher than 120 g/m$^2$, and preferably higher than 130 g/m$^2$, to thus allow an adequate thermal and mechanical seal during the molding.

Advantageously, the electroconductive portions 14 can be suitably printed on the upper surface of the fabric 20 of the first layer 6 so as to carry the logo or the name of the manufacturing company of the element 2, or other symbols, decorations or textures.

Conveniently, in a possible embodiment, the element 2 is defined exclusively by said first layer 6.

Conveniently, in another possible embodiment, the element 2 consists of a multilayer 4 comprising said first layer 6 and further underlying layers, such as a second metallized layer 8 and/or an internal layer 10 and/or an underlying support layer 18, as described below.

Advantageously, the multilayer 4 of the element 2 can have an overall thickness substantially less than 1 mm, preferably less than about 0.5 mm and, even more preferably, less than 0.35 mm.

Advantageously, the covering element 2, and in particular one or more of the layers that make up and define the multilayer 4 of said element, can be subjected to a traditional antibacterial treatment with biocides (for example by means of the technology called Sanitized®) or permanent bacteriostatic without biocides (for example through the technology called Abatox®). Conveniently, this allows an important antibacterial and/or bacteriostatic action, which is especially useful for those who use the element sporadically. Advantageously, said bacteriostatic and/or antibacterial treatment can be carried out by treating (ie spraying, immersion, or other) with compounds containing silver and/or graphene particles.

Figure 4:
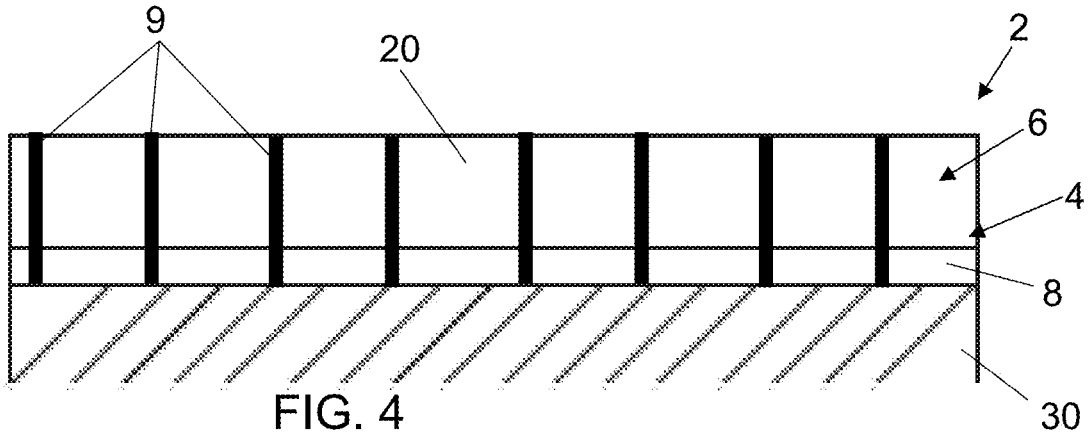
FIG. 4 shows it in a third embodiment.

Advantageously, to reduce the reflection of heat and steam towards the upper surface and therefore towards the outside, which could be unpleasant for the operator who is ironing, one or more of the layers that make up the multilayer 4, and preferably all the layers which make up the multilayer 4, may have through holes 9 (see FIG. 4, 5). Conveniently, the presence of the holes 9 allows the heat emitted by the iron 21 to pass through the element 2, thus allowing its dispersion and in particular reducing the reflection of the heat itself towards the upper surface of the element 2 and towards the operator.

Conveniently, the holes 9 can have a diameter of about 0.1 mm up to a maximum of about 3-4 mm. Conveniently, the holes 9 can have a density of about 3000-15000 holes per square meter.

Advantageously, the holes 9 can be distributed in a regular manner over the entire surface development of the element 2.

Conveniently, the holes 9 in the fabric layers can be defined by the interspaces provided in the locally enlarged weft of the fabric itself.

Figure 5:
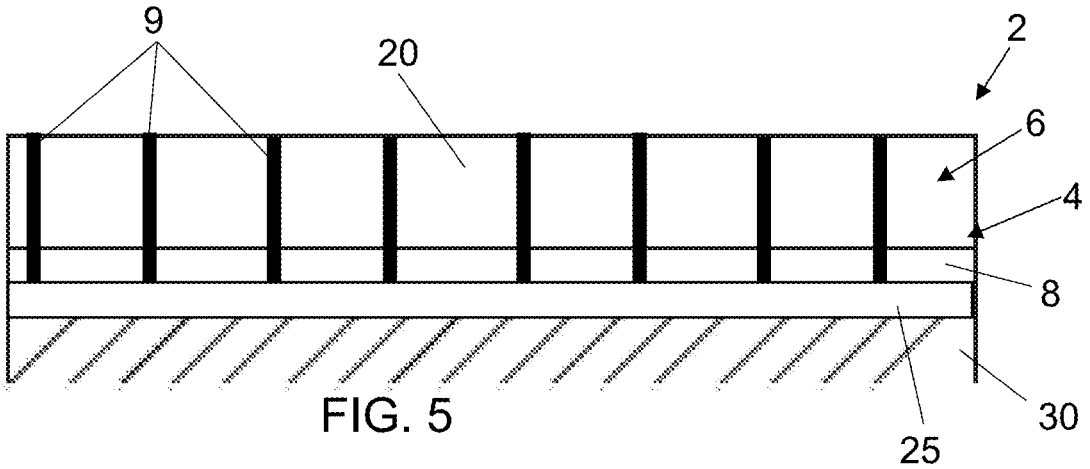
FIG. 5 shows it in a fourth embodiment.

Advantageously, in this case, the multilayer 4 can comprise at the bottom an underlying continuous membrane 25—that is, not perforated—(see FIG. 5) which is heat resistant. Conveniently, this membrane 25 protects the ironing surface 30 from the heat and steam that passes through the holes 9. Preferably, this membrane 25 is made of insulating material such as for example cork, wood fiber, glass fiber, ceramic or cotton wadding. Polystyrene.

Advantageously, the element 2 can comprise a second layer 8 which is metallized, preferably aluminized, and which is positioned inferiorly/internally with respect to the first layer 6. Conveniently, said second layer 8 of the multilayer 4 is thermally reflective. Preferably, the second layer 8 is metallized and allows the heat developed by the iron 21 to be at least partially reflected, with the double result of avoiding excessively heating the underlying ironing surface 30 and of keeping warmer the garment being ironed. Furthermore, when using a steam iron 21, the aluminum layer also allows the steam generated by the iron 21 to be reflected, thus preventing wetting of the ironing surface 30 and creating a sort of air cushion and steam which facilitates the sliding of the iron itself, thus making the ironing operation simpler, more effective and therefore faster.

Conveniently, in a possible embodiment, the element 2 consists exclusively of said first layer 6, which is coupled at the bottom to the second layer 8.

Conveniently, in a possible embodiment, the upper surface of the second layer 8 of the multilayer 4 can be intended to be in contact with the first layer 6, while the lower surface of the second layer 8 can be intended to be in direct contact with the ironing surface or to be closer to the latter.

Advantageously, the first layer 6 of the multilayer 4 is associated with the underlying second layer 8 by means of lamination/coupling with points or full field or with powders, preferably with polymeric glue and/or hot-melt resin (for example with reactive polyurethane), so as to guaranteeing the stable and lasting union between the two layers and avoiding any detachment or damage deriving from the heat and/or steam generated by the iron 21 during use. Conveniently, this type of coupling allows to obtain a multilayer 4 which, without requiring further specific treatments, is smooth and uniform in correspondence with the upper surface, on which the garments are intended to be placed, so as to facilitate the smoothness of the iron 21 during ironing and, at the same time, prevents the garments from moving relative to the ironing board during this operation.

Advantageously, the second layer 8 of the multilayer 4 can comprise a film or sheet of metal, preferably of aluminum, which faces the first layer 6. Preferably, said film or said sheet is continuous.

Preferably, the second layer 8 of the multilayer 4 can be made of aluminum, copper or silver, or other metals having good heat reflection properties.

Advantageously, the second layer 8 of the multilayer 4, in particular when it is in the form of a foil, can be applied directly to the first layer 6, preferably by using glues, for example silicone resins, and preferably thermosetting resins.

Advantageously, the second layer 8 of the multilayer 4 can be deposited directly on the first layer 6 by chemical methods, for example from solution using colloidal suspensions of metal particles inside which the first layer 6 is immersed one or more times, or which can be sprayed on the layer itself by means of nebulizers, or by physical methods, such as deposition by sputtering or evaporation.

Advantageously, in a possible embodiment, the second layer 8 can consist only of said metal film or sheet, preferably of aluminum.

Advantageously, in a possible embodiment, the second layer 8 of the multilayer 4 can comprise a support substrate, which is coated at the top with a sheet, preferably continuous, of metal, preferably of aluminum. Conveniently, the metal sheet, preferably aluminum, is associated by gluing to the support substrate. Preferably, the metal film has a thickness substantially of the order of microns.

Advantageously, in a possible embodiment, the second layer 8 of the multilayer 4 can comprise a support substrate on which the metal, preferably aluminum, is sprayed (for example by deposition by "sputtering") or vaporized under vacuum. Preferably, the vacuum sprayed or vaporized aluminum has a thickness substantially comprised between 10 nm and 1 μm.

Preferably, the support substrate is made of polymeric material, such as polyester (PL), polyamide (PA), polypropylene (PP), polyurethane (PU), polytetrafluoroethylene (PTFE), expanded polytetrafluoroethylene (ePTFE) and/or other similar materials. Conveniently, in a possible embodiment, said substrate can be represented by an internal layer 10, as will be described below.

Advantageously, the second layer 8 of the multilayer 4 can be colored by painting or by using a solid solution to obtain an optical effect different from that of the simple aluminum foil.

Advantageously, the second layer 8 can comprise a plurality of through openings, which cross the layer from side to side. Advantageously, said through openings can correspond to the holes 9. Conveniently, the through openings can be defined by holes which are obtained by through perforation of the second layer 8, preferably with wedged, solid or hollow cylinders, or by traditional blanking. Conveniently, the through openings can be defined by discontinuities, preferably microscopic interstices, present between the metal particles (preferably aluminum) which has been applied by spraying or by vacuum vaporization.

Advantageously, the process for associating said first layer 6 to said second layer 8 can be as follows.

The adhesive glue/resin, preferably polyurethane, is suitably heated to a temperature between 80° C. and 140° C., preferably 100-120° C., and is then spread on the lower surface of the first layer 6 and/or on the upper surface of the second metallized layer 8. Subsequently, the two layers 6 and 8 are then brought together and joined together at the surface coated with the glue. Then, the assembly formed by the two layers 6 and 8, joined together, then passes into a calender having a working pressure which is suitably controlled so as to cause a temporary and localized reduction of the overall thickness of the assembly being formed. In particular, the working pressure of the calender must be suitably controlled since, in the case of too low pressure, adequate gluing and consequent stable and permanent coupling of the two layers 6 and 8 would not be obtained.

Advantageously, the calendering of the coupled formed by the first fabric layer 6 and the second metallized layer 8 makes the upper surface of the first layer 6 particularly smooth and uniform, without the use of any chemical treatment.

Figure 8:
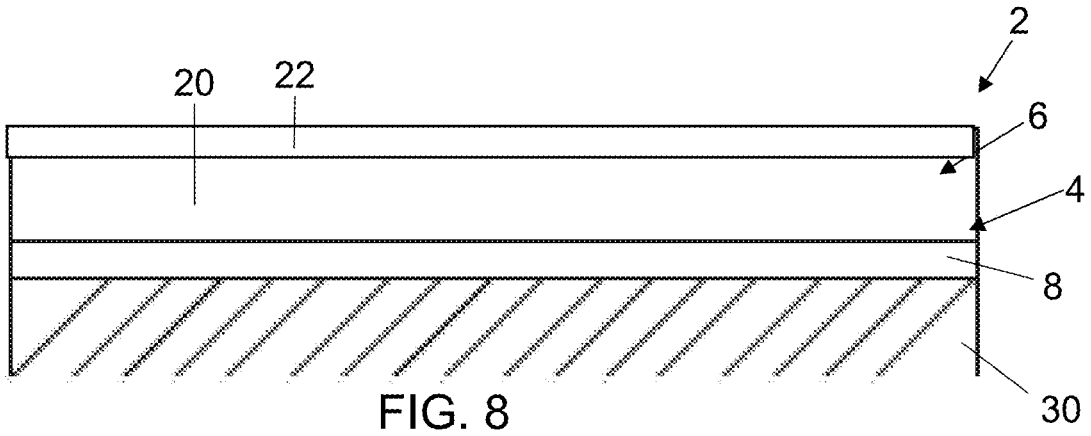
FIG. 8 shows it in a seventh embodiment.

Advantageously, the upper and/or external surface of the element 2 can provide an anti-stain or oil and/or water-repellent treatment. Advantageously, for this purpose, a coating layer 22 made of oil and/or water-repellent material can be provided—preferably above the first layer 6 (see FIG. 8). Preferably, said coating layer 22 can be made of a material which allows the passage of water vapor.

Conveniently, the application of this coating layer 22 can confer anti-stain and self-cleaning properties to the surface of the element 2, thus allowing the element to be preserved over time. Advantageously, this allows avoiding dirtying the garments, which are placed on said surface to be ironed, and, in particular, it prevents the stain from being immediately "fixed" on the ironed garment by the passage of the iron 21 at high temperature.

Furthermore, said coating layer 22 allows improving the durability of the corresponding zone of the element 2, improving its conservation.

Advantageously, said coating layer 22 can be obtained by spraying with poly-tetrafluoroethylene (PTFE), also known as Teflon®. Conveniently, this coating layer 22 can be obtained by applying a super-hydrophobic protective layer, for example by the deposition of polymers, for example polyurethane, acrylic, or other materials that have suitable nanostructures (in particular the presence of valleys and mounts separated in height by at least 100 nm and at high density). Conveniently, said coating layer 22 can comprise silicone-based polymers, or other composite materials endowed inter alia with lubricating properties.

Figure 9:
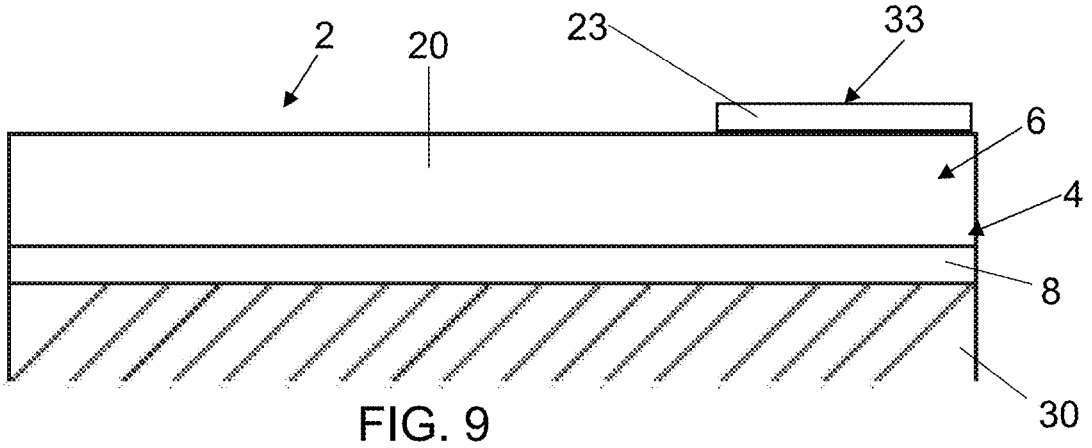
FIG. 9 shows it in an eighth embodiment
Figure 10:
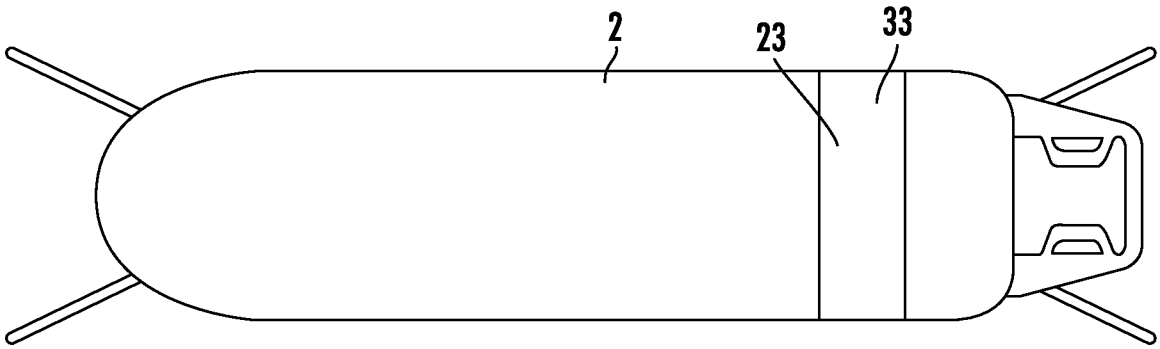
FIG. 10 shows in plan the element of FIG. 9 mounted on an ironing board.

Advantageously, the element 2 comprises, for its entire surface development or in correspondence with a zone 33 (see FIGS. 9, 10), an external coating 23 with a lubricating material to lubricate the plate of the iron so as to clean it and thus make the ironing action smoother. Preferably, the zone 33 also defines a zone of the element that can be used by the user also for the stretching operations. Preferably, this lubricating material is silicone based.

Figure 11:
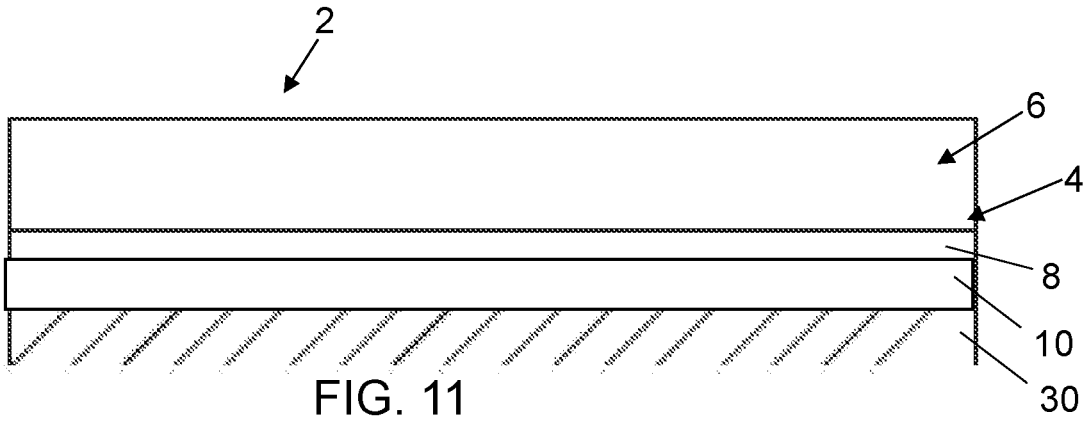
FIG. 11 shows in schematic vertical section the element in a ninth embodiment.
Figure 12:
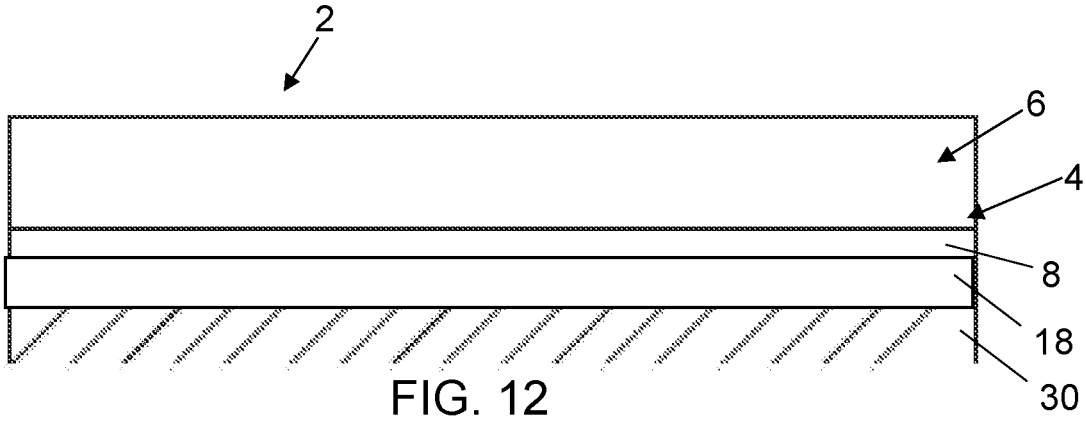
FIG. 12 shows it in a tenth embodiment.
Figure 13A:
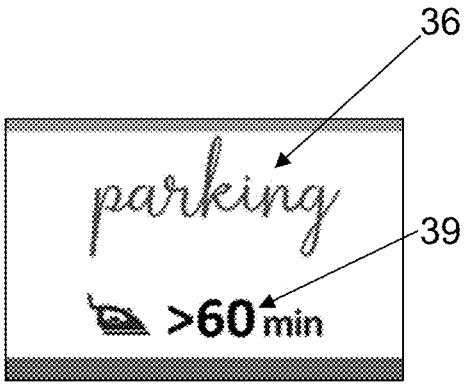
FIGS. 13*a* and 13*b* show corresponding examples of the prints applied on the upper/outer surface of the cover element.
Figure 13B:
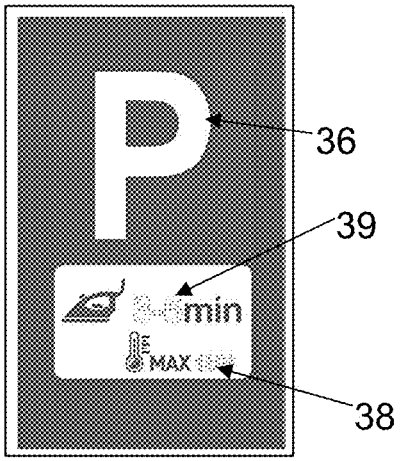
Figure 14:
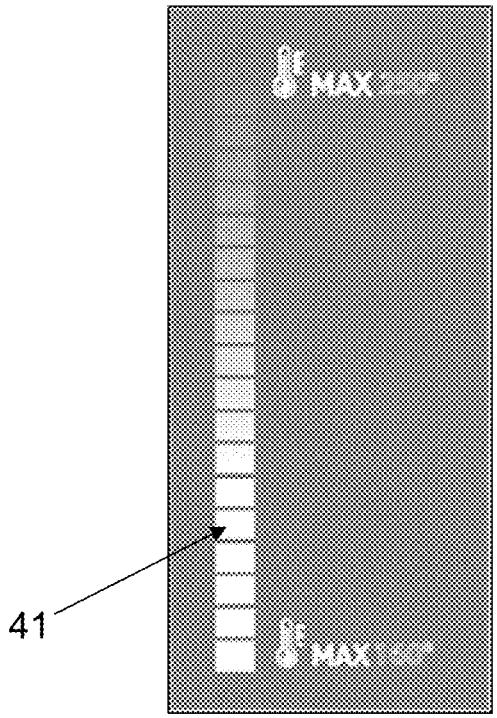
FIG. 14 shows an example of a heat sensitive strip provided on the upper/outer surface of the cover element in order to indicate the temperature of the heated plate of said iron.

Advantageously, at its innermost/lower surface, the covering element 2 can further comprise an internal layer 10 (see FIG. 11), which is intended to come into direct contact with the ironing surface 30 and which, preferably, is configured to increase the friction between the same element 2 and the underlying ironing surface 30. Preferably, said inner layer 10 can be applied directly below said first layer 6 or below said second layer 8 (if provided), while the lower and/or inner surface of said layer 10 is in direct contact with the ironing surface 30.

Advantageously, said inner layer 10 can give a braking effect, which substantially immobilizes the element 2 with respect to the underlying ironing surface 30. Conveniently, this is useful to avoid the formation of wrinkles or folds in the element 2 which could then negatively affect the result of ironing, for example impious causing creases on the ironed garment, or making the movement of the iron 21 less smooth. Furthermore, the presence of said internal layer 10 allows to avoid the sliding of the element 2 with respect to the underlying surface, avoiding undesired operations to put the iron back into position.

Preferably, said inner layer 10 can be in rubberized material and can be obtained by applying (for example by means of glues) a polymeric layer, for example in polyethylene (PE) added with ethylene vinyl acetate (EVA) directly on the layers 6 or 8, or a fabric layer can be used on which a rubber effect print has been applied using traditional methods.

Advantageously, said layer 10 can substantially affect the entire surface extension of the element 2 or it can involve only some areas of this. Conveniently, in this second case, it is understood that the thickness of said inner layer 10 is sufficiently thin not to cause depressions and bumps on the outer surface of the element 2. Conveniently, said inner layer 10 can be provided in a continuous or discontinuous manner. Conveniently, the localized application of said further inner layer 10 can use repeated motifs, for example striped or checkered, to thus obtain a suitable distribution of the lower surface parts affected by the layer 10 so as to confer a uniform braking effect and avoid localized sliding phenomena.

Advantageously, in a possible embodiment, said inner layer 10 can define the substrate on which said second layer 8 made of metallized material is deposited.

Advantageously, the element 2 can also comprise at least one underlying support layer 18. Conveniently, said at least one underlying support layer 18 is shock absorbing. Preferably, said at least one underlying support layer 18 is made of soft material, so as to prevent accidents, such as impacts or the fall of the iron 21, from damaging the top, and/or in any case to make the action of ironing. Preferably, said at least one support layer 18 is resistant to high temperatures, in particular it is made of at least one material which resists, without undergoing any damage or alteration, to temperatures higher than about 180° C., preferably of about 200-400° C., and more preferably about 200-240° C., for at least 5 minutes, preferably for 10-15 minutes up to several days. Preferably, said at least one support layer 18 is also made of a material, which is thermally insulating, that is, it is suitable for significantly reducing the passage of heat through the layer itself.

Preferably, said at least one support layer 18 is made of polymeric materials, for example polyester, or expanded polyurethane, and/or of natural fabrics, such as felt or cotton. Preferably, said at least one support layer 18 can consist of:

at least one rubber layer, or at least one layer of felt, or a layer of rubber and one of felt.

Preferably, said at least one support layer 18 can be made of fleece or needle-punched fibers, preferably of polyester or polyurethane foam, and resistant to high temperatures (i.e. resistant to temperatures higher than about 180° C., preferably of about 200-400° C., and more preferably about 200-240° C., for at least 5 minutes, preferably for 10-15 minutes up to several days).

Preferably, said at least one support layer 18 can be made of phosphorus viscose and/or modacrylic fibers, both resistant to high temperatures (i.e. resistant to temperatures at temperatures higher than about 180° C., preferably of about 200-400° C., and more preferably of about 200-240° C., for at least 5 minutes, preferably for 10-15 minutes up to several days) and also thermally insulating, i.e. capable of significantly reducing the heat that the heated plate of the iron can crossing the layer 18 to arrive at the ironing surface 30, thus protecting the latter.

Advantageously, said at least one support layer 18 can comprise an upper and/or outer layer of felt, in order to improve thermal insulation and resistance to high temperatures, and a lower and/or inner layer, for example of expanded polyurethane.

Preferably, said at least one support layer 18 of the element 2 is intended to be in direct contact with the ironing surface 30. Conveniently, in a possible embodiment, said underlying at least one support layer 18 of the element 2 is positioned above said further inner layer 10, if provided.

Advantageously, in a possible embodiment, the element 2 consists only of said first layer 6 coupled to the underlying support layer 18. Preferably, in a possible embodiment, the element 2 consists only of a first layer 6 in fabric 20 of aramidic fibers, which is coupled to an underlying support layer 18 of expanded polyurethane. Preferably, in a possible embodiment, the element 2 consists only of a first layer 6 of fabric 20 of aramidic fibers, which is coupled to an underlying support layer 18 of felt.

Advantageously, moreover, said at least one support layer 18 can have good thermal insulation properties, in order to further protect the ironing surface 30.

Conveniently, said at least one support layer 18 can be applied to the other layers of the element 2 by means of the use of polymeric glues, and preferably thermosetting resins.

Conveniently, in a possible embodiment, the support layer 18 can comprise at least one layer of cloth, or fleece, in order to improve the damping effect of the element 2.

Conveniently, said at least one support layer 18 can comprise and/or be defined by a waterproof, and preferably also breathable membrane. In particular, the membrane is waterproof, to prevent the passage of liquids, and it is also breathable, to allow the passage of water vapor. Preferably, said membrane is polymeric, for example it is a PTFE, polyester or Teflon® membrane. Preferably, the waterproof membrane is configured to withstand, without undergoing any damage or alteration, temperatures higher than about 180° C., preferably about 200-400° C., and more preferably about 200-240° C., for at least 5 minutes, preferably for 10-15 minutes up to several days.

Preferably, in a possible embodiment, the element 2 consists of a first layer 6 of fabric 20 which is directly coupled (i.e. without the interposition of further layers) to an underlying support layer 18 which is defined only by the waterproof membrane, and preferably breathable, for example a membrane made of Teflon®, which resists, without undergoing any damage or alteration, to temperatures higher than about 180° C., preferably about 200-400° C., and more preferably about 200-240° C., for at least 5 minutes, preferably for 10-15 minutes up to several days. Conveniently, the first fabric 20 layer 6 is in direct contact—and in particular it is directly coupled—with the underlying support layer 18 which is defined by the waterproof membrane, in order to avoid the passage of moisture towards the ironing surface 30, and which is preferably also breathable.

Preferably, the upper and/or external surface of said at least one support layer 18 can be coated with an impermeable coating, for example in Teflon®, or in any case which allows the passage of water vapor, retaining the liquids outside.

Conveniently, in a possible embodiment, said element 2 is constituted by said first layer 6 and by an underlying fabric layer, preferably in natural fibers (for example in cotton) and/or polymeric.

Conveniently, in a possible embodiment, said element 2 is constituted by said first layer 6 and by an underlying fabric layer, preferably in natural fibers (for example in cotton) and/or polymeric.

Conveniently, in a possible embodiment, said element 2 comprises a layer of non-woven fabric, preferably of fibers resistant to high temperatures.

Advantageously, at least one sign 36 (for example the parking symbol "P" or the wording "park" or "parking") can be printed or applied on the outer/upper surface of said covering element 2 to indicate that said element it allows the iron 21 to stop with the heated plate placed in any surface area on the element itself. Conveniently, for this purpose, said covering element 2 comprises for its entire surface development said first layer 6 of fabric 20 resistant to high temperatures.

Advantageously, moreover, on the outer/upper surface of said covering element 2 a print 39 can be provided or a mark can be applied (for example it can be sewn) to indicate the interval and/or the maximum time value (for example expressed in minutes) for which it is ensured that the heated plate of the iron 21 can rest in any surface area of said element 2 without the plate itself damaging or deforming said element 2. Conveniently, for this purpose, said heating cover element 2 comprises along its entire surface extension said layer 6 of fabric 20 resistant to high temperatures and, in particular, the fibers of said fabric 20 are made of a suitable material which is not damaged and/or deformed if the heated plate of the iron 21—which is therefore at the temperature set for the ironing operation—lies on the element itself for a time that is at least equal to the value and/or the time interval indicated by said print 39 or by said sign.

In other words, if the heated plate of the iron 21 rests on any area of the surface of said cover element 2 (i.e. when the activated iron 21, with the heated plate, is positioned horizontally) for a period of time equal to or less than said interval and/or time value indicated by said sign, then surely said covering element 2 is not damaged (for example it is not burned), damaged, deformed or irreversibly altered. Conveniently, said sign can define a number corresponding to the interval/limit value after which there is a damage or alteration, or it can define a number that—for safety—is lower than the interval/limit value after which there is damage or alteration.

Conveniently, this interval and/or time value can be indicated for one or more temperatures that can be reached by the heated plate of the iron 21. Advantageously, in addition to the print and/or sign to indicate the interval and/or time value, it can advantageously be a further print 38 or a further sign (for example it can be sewn) which indicates the corresponding temperature, in particular the maximum temperature (indicated by said further print 38 and/or sign), at which it is guaranteed that the heated plate of the iron 21 can remain, for that determined interval and/or time value (indicated by said print 39 and/or mark), on any area of said covering element 2 without the plate itself damaging or deforming said element cover 2.

Advantageously, moreover, on the outer/upper surface of said cover element 2 a strip or an insert or, in general, a portion 41 made of thermosensitive material can be provided and which, in particular, is configured in such a way as to change color according to the temperature of the heated plate of the iron 21, thus allowing the user to indicate the temperature of said heated plate to the user.

From what has been said it is clear that the element for covering ironing surfaces according to the invention is particularly advantageous in that it:

allows you to leave the iron resting on any area of the surface of the element itself for an indefinitely long time without causing a risk of fire, allows you to make the act of ironing simple, quick and not tiring, makes the ironing operation more comfortable and easier for the user, reduces the risk of damage to clothing, reduces the risk of fire.

In particular, unlike the traditional solutions described in US2013/111787, DE202014004202, U.S. Pat. Nos. 3,667,142 and 3,733,724, the solution according to the present invention provides for the simultaneous presence of at least one upper layer 6, which is suitable to be used for stretching operations and which resists high temperatures, thus ensuring optimal protection of the underlying ironing surface from the high temperatures reached by the iron, and an underlying waterproof membrane that prevents the passage of liquids towards the underlying ironing surface, thus preventing the latter from being able to get wet or wet.

The present invention has been illustrated in a preferred embodiment thereof, but it is understood that executive variations may be applied to it in practice, without however departing from the scope of protection of the present patent for industrial invention.

The invention claimed is:

1. Cover element (2) for an ironing surface (30), the cover element comprising:

a first layer (6) of fabric (20) which extends substantially for an entire surface development of said cover element (2), said first layer (6) being constituted by a fabric (20) comprising fibers that resist, without undergoing any damage or alteration, temperatures above about 180° C., for at least 5 minutes, and at least one underlying support layer (18), which is positioned below said first layer (6) and which comprises an impermeable polymeric membrane, wherein said impermeable polymeric membrane of said support layer (18) is also breathable and is configured in such a way as to resist without undergoing any damage or alteration, to temperatures higher than about 180° C., for at least 5 minutes.

2. The cover element according to claim 1, wherein said fibers of said fabric (20) resist, without undergoing any damage or alteration, temperatures of at least 200-400° C., for at least 10-15 minutes, and comprise, at least partially or entirely, aramid fibers.

3. The cover element according to claim 1, wherein said fibers of said fabric (20) resist, without undergoing any damage or alteration, temperatures of at least 200-400° C., for at least 10-15 minutes, comprise about 30-70% of aramid fibers and about 30-70% of viscose.

4. The cover element according to claim 1, wherein said first layer (6) of fabric (20) also comprises wires (17) or inserts of electro-conductive material.

5. The cover element according to claim 1, further comprising a print (39) and/or a sign to indicate a time interval and/or a time value for which it is ensured that a heated plate of an iron (21) can rest on any area of the surface of said cover element (2) without the heated plate itself damaging, altering or deforming said cover element (2), the fibers of said fabric (20) of said first layer (6) are made of a material that is not damaged and/or altered and/or deformed if the heated plate of the iron (21), which is at a temperature required for an ironing operation, lies on the cover element itself for a time which is equal to the value and/or the time interval indicated by said print (39) or by said sign.

6. The cover element according to claim 1, further comprising a second layer (8) which is metallized and which is positioned below said first layer (6).

7. The cover element according to claim 1, further comprising an internal layer (10) which is positioned below said at least one underlying support layer (18) and which is in contact with said ironing surface (30) to be covered and which is configured to increase the contact friction between said element (2) and said ironing surface (30) to be covered.

8. The cover element according to claim 1, further comprising a further layer (22) of external covering which is positioned above said first layer and which is made of oil-repellent and/or water-repellent material.

9. The cover element according to claim 1, wherein said underlying support layer (18) further comprises:

at least one layer of rubber, or at least one layer of felt, or at least one layer of rubber and at least one of felt.

10. The cover element according to claim 1, wherein said impermeable polymeric membrane of said support layer (18) is made of polytetrafluoroethylene (PTFE) or polyester.

11. Cover element (2) for an ironing surface (30), the cover element comprising:

a first layer (6) of fabric (20) which extends substantially for an entire surface development of said cover element (2), said first layer (6) being constituted by a fabric (20) comprising fibers that resist, without undergoing any damage or alteration, temperatures above about 180° C., for at least 5 minutes, and at least one underlying support layer (18), which is positioned below said first layer (6) and which comprises an impermeable polymeric membrane, wherein said first layer (6) is coupled directly to the impermeable polymeric membrane of said support layer (18).

12. The cover element according to claim 1, wherein the cover element is comprised of only of said first layer (6) which is coupled directly to the underlying waterproof membrane which alone defines said support layer (18), which is intended to directly contact with the ironing surface (30) which is covered with said covering element (2).

13. The cover element according to claim 1, wherein said at least one support layer (18) further comprises at least one layer made of cloth or needle-punched fibers.

14. The cover element according to claim 1, wherein the cover element has an overall thickness which is less than about 1 mm.

15. Cover element (2) for an ironing surface (30), the cover element comprising:

a first layer (6) of fabric (20) which extends substantially for an entire surface development of said cover element (2), said first layer (6) being constituted by a fabric (20) comprising fibers that resist, without undergoing any damage or alteration, temperatures above about 180° C., for at least 5 minutes, and at least one underlying support layer (18), which is positioned below said first layer (6) and which comprises an impermeable polymeric membrane, wherein said fibers of said fabric (20) resist, without undergoing any damage or alteration, temperatures of at least 200-400° C. for at least 10-15 minutes.

16. The cover element according to claim 1, wherein the cover element has an overall thickness, which is less than about 0.5 mm.

17. The cover element according to claim 1, wherein the cover element has an overall thickness, which is less than about 0.35 mm.

* * * * *